US005568234A

United States Patent [19]

Shiba

[11] Patent Number: 5,568,234

[45] Date of Patent: Oct. 22, 1996

[54] IMAGE DENSITY CONTROL DEVICE

[75] Inventor: Hiroshi Shiba, Yokohama, Japan

[73] Assignee: Canon Kabushiki Kaisha, Tokyo, Japan

[21] Appl. No.: 366,927

[22] Filed: Dec. 30, 1994

[30] Foreign Application Priority Data

Dec. 30, 1993 [JP] Japan ..... 5-354307

[51] Int. Cl.[6] ..... G03G 21/00

[52] U.S. Cl. ..... 355/246; 355/208; 355/214

[58] Field of Search ..... 355/246, 208, 355/203, 204, 214, 69, 326 R, 327; 118/688–691

[56] References Cited

U.S. PATENT DOCUMENTS

| | | | |
|---|---|---|---|
| 4,277,162 | 7/1981 | Kasahara et al. | 355/208 |
| 4,502,778 | 3/1985 | Dodge et al. | 355/246 X |
| 5,175,585 | 12/1992 | Matsubayashi et al. | 355/208 |
| 5,250,988 | 10/1993 | Matsuura et al. | 355/208 |
| 5,294,959 | 3/1994 | Nagao et al. | 355/208 |
| 5,307,119 | 4/1994 | Folkins et al. | 355/208 |
| 5,325,153 | 6/1994 | Mitsuse et al. | 355/203 |
| 5,400,120 | 3/1995 | Narazaki et al. | 355/208 |

FOREIGN PATENT DOCUMENTS

| | | |
|---|---|---|
| 50-50935 | 5/1975 | Japan . |
| 50-93437 | 7/1975 | Japan . |

*Primary Examiner*—Matthew S. Smith

*Attorney, Agent, or Firm*—Fitzpatrick, Cella, Harper & Scinto

[57] ABSTRACT

A density control device includes an image forming unit for forming a sample image having a predetermined density onto a recording medium, a density detecting unit for detecting the density of the surface of the recording medium, and a control unit for causing the density detecting unit to detect a first density of an area where no sample image is formed on the recording medium and a second density of an area where any sample image is formed, and determining the operation conditions of the image forming unit, based on a contrast value between the first density and the second density which have been detected.

14 Claims, 14 Drawing Sheets

IMAGE DENSITY CONTROL DEVICE

BACKGROUND OF THE INVENTION

1. Field of the Invention

The present invention relates to a density control in an image forming apparatus.

2. Related Background Art

In color image forming apparatuses of the electrophotographic type, a full-color image is formed on the recording paper by repeating multiple times a process of transferring a toner image formed by electrification, exposure and development on a photosensitive drum onto the recording paper. An image forming apparatus of this type was described in Japanese Laid-open Patent Application No. 50-50935.

The conventional art will be described below based on the accompanying drawings.

FIG. 16 is a cross-sectional view showing an example of a color image forming apparatus. As shown in the figure, within the apparatus, there are disposed a photosensitive drum 1, a roller electrifier 3, and to the right side of the photosensitive drum 1, a plurality of developing cartridges 4*a*, 4*b*, 4*c*, 4*d* each having a toner container and a developing unit integrally formed as a cartridge, which can be exchanged if the toner contained has been consumed, and freely detached from a main unit of the apparatus, each of the developing cartridges 4*a*, 4*b*, 4*c*, 4*d* being carried by a rotatable support 9, and having a respective developing opening face 5*a*, 5*b*, 5*c*, 5*d* set on the same cylinder about the center of a rotational shaft of the support 9.

FIG. 17 is a cross-sectional view for explaining the detailed constitution of developing cartridges as shown in FIG. 16.

In the figure, a yellow toner 4*a*-1, a magenta toner 4*b*-1, a cyan toner 4*c*-1, and a black toner 4*d*-1 are contained within the developing cartridges 4*a*, 4*b*, 4*c*, 4*d*, respectively, and further the application rollers 6*a*, 6*b*, 6*c*, 6*d* and the toner regulating members 7*a*, 7*b*, 7*c*, 7*d* are provided, wherein the toner application rollers 6*a*, 6*b*, 6*c*, 6*d* are rotated with the rotation of developing rollers 8*a*, 8*b*, 8*c*, 8*d* to apply the toners onto the developing rollers 8*a*, 8*b*, 8*c*, 8*d*.

The material of the regulating members may be nylon when the toner is negatively polarized, or silicone rubber when it is positively polarized. That is, the material electrified oppositely to the polarity of the toner is preferred. Also, the peripheral speed of the developing rollers 8 is preferably chosen in a range of 1.0 to 2.0 times that of the photosensitive drum 1.

The developing cartridges 4*a*, 4*b*, 4*c*, 4*d* mounted on the rotational shaft of the support 9 are driven so that any one of the developing opening faces 5*a*, 5*b*, 5*c*, 5*d* of the developing cartridges 4*a*, 4*b*, 4*c*, 4*d* is always opposed to the surface of the photosensitive drum 1, as shown in FIG. 17. One example of the driving method was detailed in Japanese Laid-open Patent Application No. 50-93437.

Note that the developing cartridge 4 can eliminate the trouble in the toner replenishment or maintenance, and can be readily exchanged by the user having no special knowledge or technique. Also, the toner useful for the developing cartridge 4 may be preferably one component developer with which the cartridge can be made simple and low cost, and easily constructed in smaller size. However, there will be no harm in using two component developer.

In FIG. 16, to the left side of the photosensitive drum 1, a transfer drum 10 having a function of carrying the transfer sheet and transferring a toner image on the photosensitive drum 1 onto the transfer sheet carried therein is disposed.

With the above constitution, the photosensitive drum 1 is driven by driving means, not shown, in a direction of the arrow as shown at a peripheral speed of 100 mm/sec.

The photosensitive drum 1 is constituted by applying a photoconductor containing an organic photosensitive component (OPC) on the peripheral external face of an aluminum cylinder having a diameter of 40 mm, but A—Si, CdS or Se may be used instead of OPC.

Upward of the main unit of the apparatus, a laser diode 11 constituting an exposure unit, a polygon mirror 13 driven for rotation by a high speed motor 12, a lens 14 and a reflection mirror 15 are disposed, whereby the electrifying roller 3 is electrified evenly at approximately −700 V with the application of an AV voltage having an AC frequency of 700 Hz and a Vp-p (peak-to-peak) voltage of −1500 V superposed on a DC voltage of −700 V.

If a signal according to image information of magenta is input into the laser diode 11, a laser beam is radiated along an optical path 16 onto the photosensitive drum 1, so that a latent image is formed at a voltage of approximately −100 V on a portion of the photosensitive drum 1 radiated by the laser beam. Further, when the photosensitive drum 1 is rotated in a direction of the arrow, the latent image is visualized by a developing cartridge 4*b*.

Further, a transfer sheet is supplied from within a transfer cassette 17 by a pickup roller 18, synchronously with forming the image onto the photosensitive drum 1, and adsorbed onto the transfer roller 10. This transfer roller 10 has an elastic layer 20 having a thickness of 2 mm wrapped around a metallic cylinder 19 having a diameter of 156 mm, and further a PVDF 21 having a thickness of 100 μm wrapped around an upper layer thereof, and is rotated at substantially the same speed as the photosensitive drum 1 in a direction of the arrow.

If the transfer sheet is supplied onto this transfer roller 10, the transfer sheet is held by a gripper 22, so that the toner image on the photosensitive drum 1 is transferred onto the transfer sheet with a voltage difference between the photosensitive drum 1 and the transfer roller 10.

The above process is repeated as well for each color of cyan, yellow and black to form a multi-color toner image on the transfer sheet.

The transfer sheet having the color image formed is peeled from the transfer roller 10 by a separation electrifier 2 and a separation claw 24, and further fused and fixed by a fixing unit 25 for heating and pressing which is conventionally well known to form a full-color image.

The remaining toner on the photosensitive drum 1 which has not been transferred onto the transfer sheet is cleaned off by a cleaning unit 26 comprised of a fur brush or blade means which is well known. Also, the toner adhering to the transfer roller 10 is preferably cleaned off by a fur brush or a transfer roller cleaning unit 27, as required.

By the way, the image forming apparatus as above described has the disadvantage that the image density change or the gradation reproducibility may become unstable, due to variations in the use environment, or in particular, humidity variations in the environment.

One of the causes of this disadvantage is the dependency of the transfer characteristics on the humidity, wherein the transfer bias is necessary to vary in a range from 2000 V to 4000 V to obtain a constant transfer current. For this purpose, a density sensor 50 is provided to control the image density so that the image density change or the gradation reproducibility may not be unstable. Conventionally, two methods have been adopted to control the image density, including a first method by detecting the density of toner image formed on the photosensitive drum and a second method by detecting the density of transfer image formed on the transfer drum.

Next, the constitution of the density sensor 50 will be described in detail.

FIG. 18 is a block diagram for explaining the configuration of a density control circuit using the density sensor 50 as shown in FIG. 16.

In the figure, 50 is the density sensor, 51 is an LED light source, 52*a* is a light receiving unit of the reflected light from the transfer drum 10, and 52*b* is a light receiving unit placed at a location capable of directly receiving a part of light from the LED light source 51. A light beam emitted from the LED light source 51 is radiated on to the toner image on the transfer drum, with a part of the light directly entering the light receiving unit 52*b*.

On the other hand, a light beam radiated on to the toner image on the transfer drum is reflected (absorbed) in proportion to the density of the toner image, the reflected light arriving at the light receiving unit 52*a*.

100 is a sequence control substrate, 101 is a CPU, 53 is a light source light amount control unit for controlling the LED light source 51 in accordance with a signal from the CPU 101, 54 to 56 are A/D converters, 57 is a monochrome data process unit, and 58 is a color data process unit.

With the above constitution, a light beam from the LED light source 51 which has arrived at the light receiving unit 52*b* is converted into the digital signal by an A/D converter 54 and sent to the CPU 101. The light emitted from the LED light source 51 and reflected from the transfer drum, upon arriving at the light receiving unit 52*a*, is converted into the digital signal by an A/D converter 55, when the toner image on the transfer drum is black (K), and passed to the monochrome data process unit 57, whereby by its comparison with a signal from the light receiving unit 52*b*, the CPU 101 sends an LED control signal to the light source light amount control unit 53 to adjust the light amount of the LED light source 51.

In a region from about 800 to 1000 nm which is a light emitting wavelength region of the LED, the black toner will absorb the light, while the color toners (M, Y, C) will reflect the light. Accordingly, when the density of color toner image is measured, the light amount of the LED light source 51 can be similarly adjusted by its comparison with the signal from the light receiving unit 52*b* through the color data process unit 58.

However, in the conventional example as above described, the light amount emitted from the light source results in the detection light amount being about 1/64, when the density detection is attempted for an image having a density of 1.8, for example.

That is, considering that the signal voltage of 5 V is a maximum detection value, the light amount is reduced to a level as low as about 78 mV, and likely affected by the noise.

As shown in FIG. 18, the density sensor unit is disposed in proximity to the surface of the transfer drum, with a measuring point of the density sensor unit located immediately behind a current transfer position from the photosensitive drum, so that the density sensor is placed remotely from the sequence control substrate, and likely affected by the noise.

In the single color printer, the output image quality could be compensated, but in the full-color printer, the image forming condition of each color component constituting the designated color was required to precisely set, even though the density was stabilized by enhancing the accuracy of each color component.

Also, there was a drawback that the parameters need be switched intricately at every time of use, because the parameters once set may be significantly affected due to environmental variations (e.g., atmospheric temperature, humidity, atmospheric pressure, sensor dirt, etc.).

SUMMARY OF THE INVENTION

It is an object of the present invention to provide a density control device with the above-mentioned drawback eliminated.

It is another object of the invention to provide a density control device which is able to set the image density without being affected by the density of an underlying surface where a patch is formed.

It is a further object of the invention to provide a density control device with an improved SN ratio of the detected density signal.

It is a still further object of the invention to provide a density control device which is able to set the stable image density without being affected by environmental variations.

Other objects of the present invention will be apparent from the following description and claims based on the accompanying drawings.

DETAILED DESCRIPTION OF THE PREFERRED EMBODIMENTS

[First Example]

Figure 1:
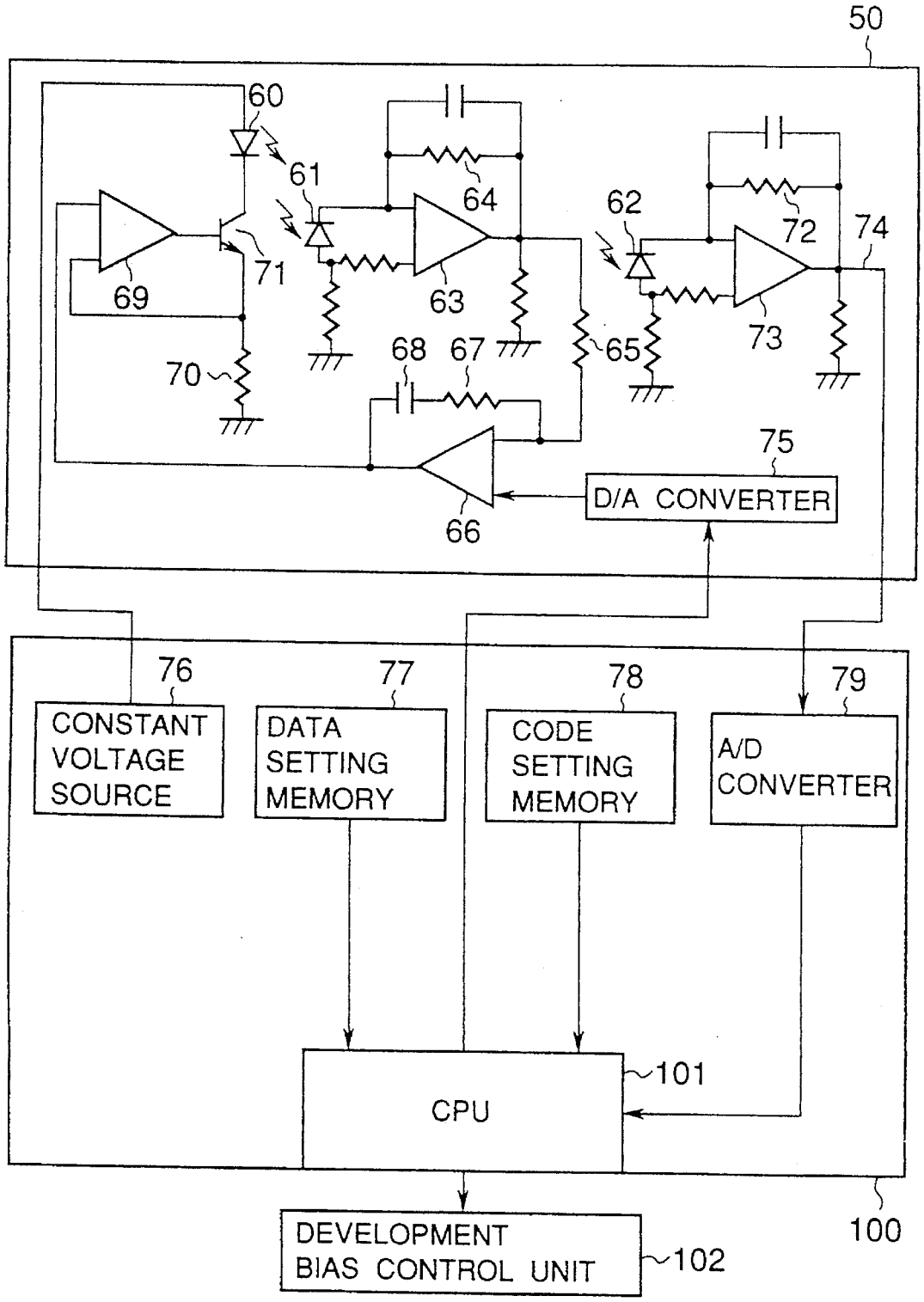
FIG. 1 is a diagram showing the configuration of a density control device in a first example of the present invention.

FIG. 1 is a diagram showing the configuration of a density control device in a first example of the present invention.

In FIG. 1, 60 is a diode serving as a light source, 61 is a reflected light measuring diode, 62 is a pin photo diode for monitoring the direct light from the light source, 63 is a voltage conversion circuit for converting the current of the reflected light measuring pin photo diode 61 into the voltage, in combination with a resistor 64, and 65 is a resistor, wherein a comparison amplifier is comprised of an operational amplifier 66, a resistor 67 and a condenser 68.

69 is an operational amplifier, 71 is a transistor, 70 is a resistor, wherein 69, 70 and 71 constitute a voltage/current conversion circuit for controlling the current flowing through the light source by accepting the output from the comparison amplifier. 73 is a voltage conversion circuit for converting the current flowed through the light source monitoring diode into the voltage, in combination with a resistor 72, 74 is the output from a sensor substrate 50, 75 is a D/A converter, 76 is a constant voltage source for supplying a constant voltage to the light source 60, 77 is a data setting memory, 78 is a code setting memory, and 79 is an A/D converter. The density control device of this example is constituted to be able to vary the development bias and the transfer voltage in accordance with the signal level acquired by a luminescent light source, a light receiving sensor, a direct light amount measuring system and a reflected light amount measuring system for the image forming process stations (photosensitive drum electrification, exposure, development, transfer) for each color of a full-color printer, whereby the proper synthesis of primary color toners can be effected, despite environmental variations, by measuring the value of a reference density member (underlying surface density) preattached to the transfer drum and the density formed by the toner, obtaining its contrast value, and determining the development bias in accordance with the contrast value.

Figure 2:
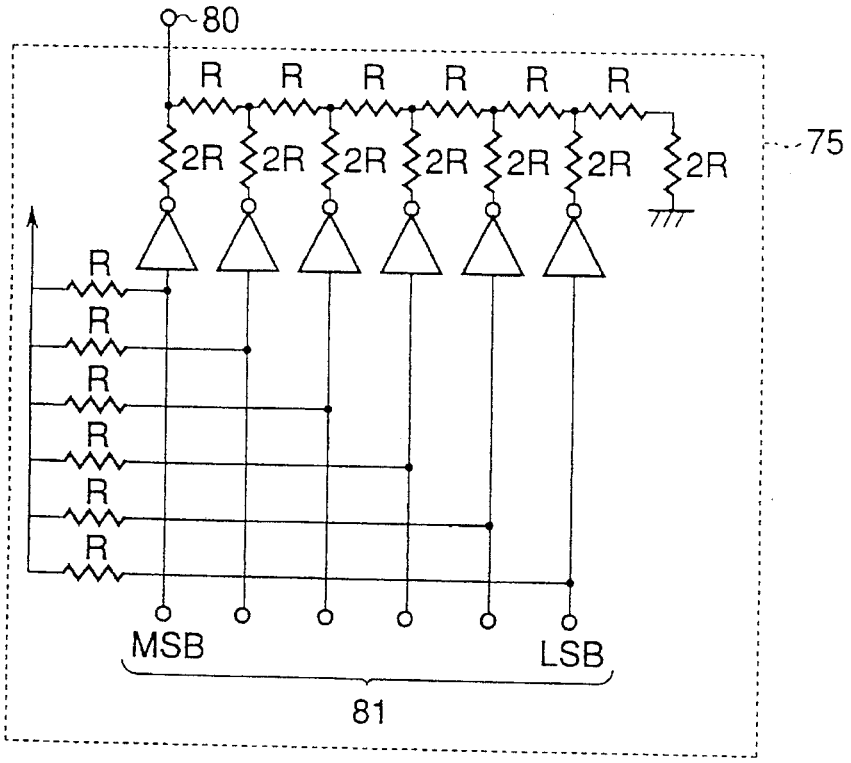
FIG. 2 is a circuit diagram showing an example of the circuit configuration of a D/A converter as shown in FIG. 1.

FIG. 2 is a circuit diagram showing an example of the circuit configuration of a D/A converter 75 as shown in FIG. 1.

In the figure, 80 is an output terminal of reference voltage signal from the D/A converter 75 to the operational amplifier 66 of the comparison amplifier, and 81 is an input terminal of code signal from the CPU 101.

The density control operation with the above configuration will be described below.

First, if a current proportional to the reflected light amount flowing through the pin photo diode 61 for the monitor is input into a minus pin of the operational amplifier 63, the operational amplifier 63 will operate to output a voltage equal to the product of its input current and the resistor 64.

Herein, the reflected light current is converted into the voltage, phase corrected and amplified by the operational amplifier 66 which functions as a feed back amplifier. Then, an analog value which is D/A converted by the D/A converter 75 based on a code signal from a sequence control substrate is input into a reference voltage terminal of the amplifier, and the value resulting from the comparison and amplification of the reflected light voltage with reference to this analog value which is a reference voltage is output from the amplifier 66.

The output resulting from the reflected light voltage compared with the reference voltage is converted into the current by the voltage-to-current conversion circuit constituted of 69 to 71 to drive the light source 60. With a series of operations as above described, the reflected light current is always controlled to equal the value of code signal sent from the sequence control substrate.

The light from the light source 60 is received into the direct light measuring pin photo diode 62, the current flowing through the diode 62 is converted into a voltage signal by the current-to-voltage conversion circuit constituted of the resistor 72 and the operational amplifier 73, which voltage signal is output as a signal 74.

Next, the operation of the sequence control substrate 100 will be described below.

The signal 74 output from the operational amplifier 73 is entered through the A/D converter 79 into a CPU 101. Herein, by comparing data of the data setting memory 77 which has stored a predicted voltage value corresponding to the toner density with the output signal 74, an optimal reference voltage value is set from the code setting memory 78, and input as the reference voltage value via the D/A converter 75 into the operational amplifier 66 (hereinafter detailed).

That is, a target reflected light voltage is preset from the sequence control substrate 100, the light amount of the light source being monitored, so that the light amount detection level is equal to an output of the reference value (code indication value) multiplied by an inverse of the reflectance (reflected light amount/illuminating light amount), whereby the sensing can be effected as the signal with a good S/N ratio.

Figure 3A:
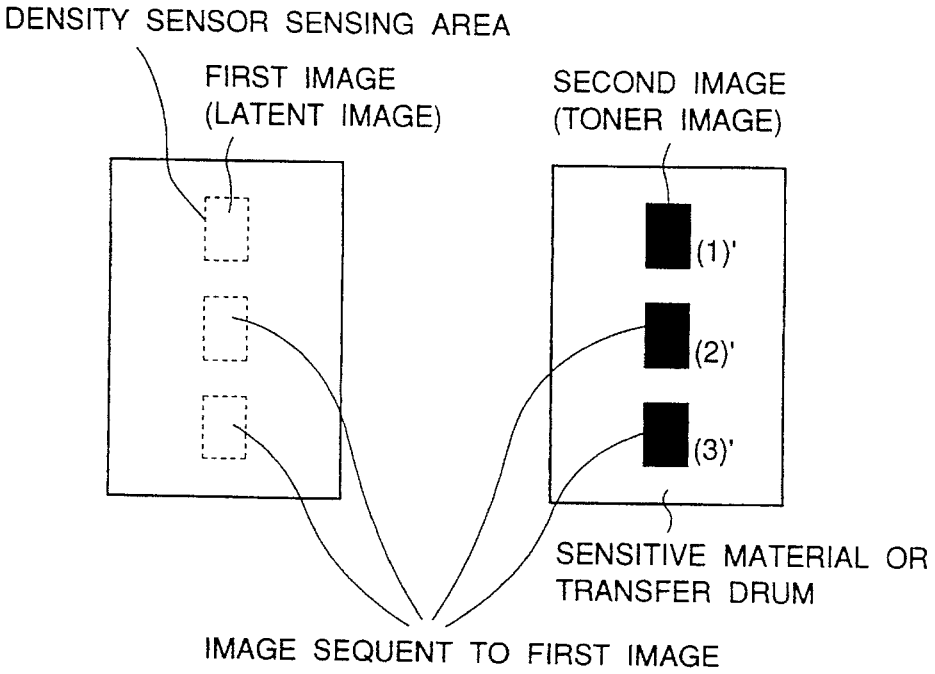
FIGS. 3A and 3B are views showing the detecting of density and the characteristic relation in the density control device according to the invention.
Figure 3B:
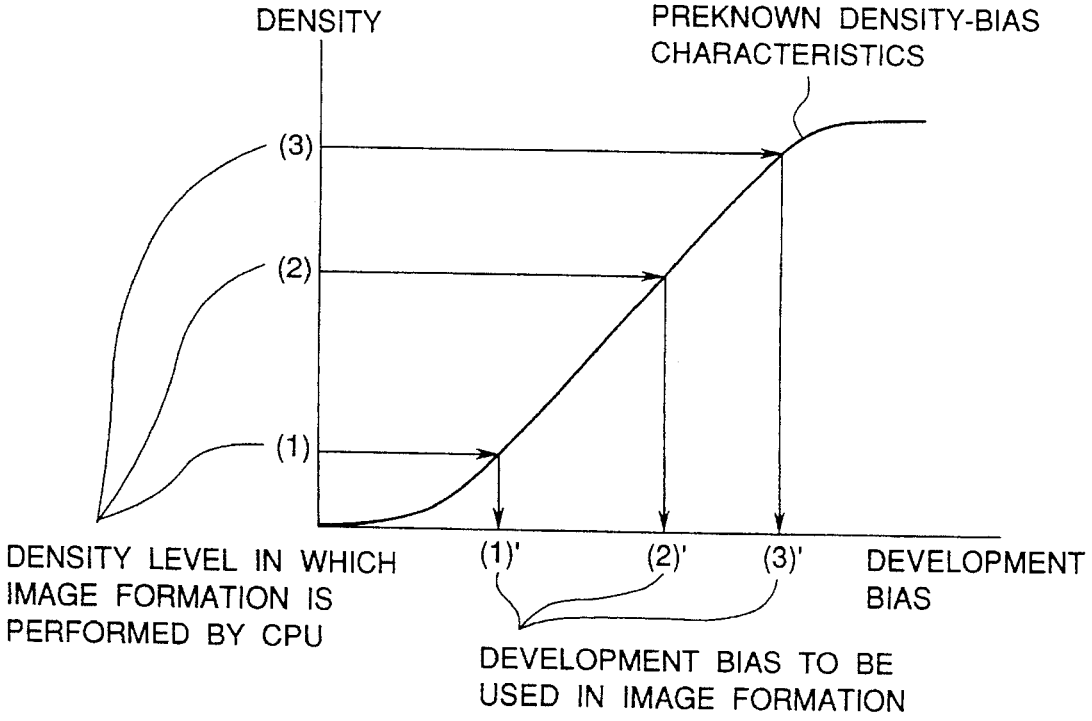

FIGS. 3A and 3B are views for explaining the correspondence between a density measuring process with the density sensor 50 as shown in FIG. 1 and a judgment process of the CPU 101. FIG. 3A shows how a latent image (first image) formed on the photosensitive drum and a toner image (second image) formed on the photosensitive drum or transfer drum are formed by a plurality of patches. FIG. 3B shows a density/development bias characteristic which is memorized in an internal memory of the CPU 101 as shown in FIG. 1.

The CPU 101 has the density values (1), (2) and (3) of toner image as data which is useful for the measurement of density to form the image by determining the development bias data (1)', (2)', (3)' to be used in the image formation in accordance with the density/development bias characteristic.

Figure 4:
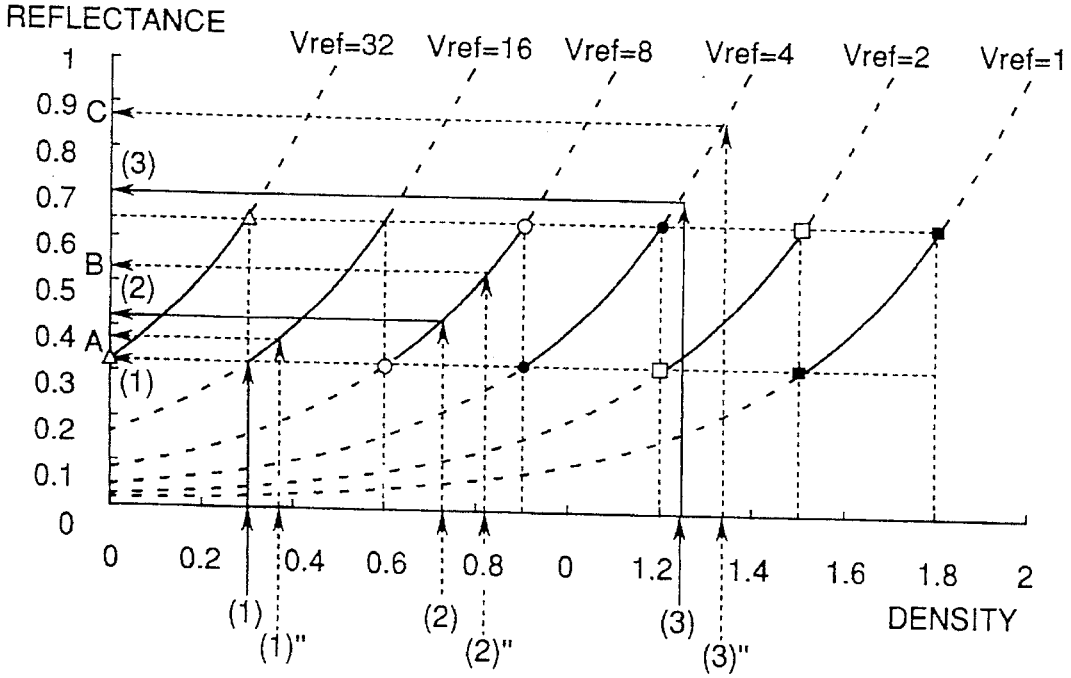
FIG. 4 is a characteristic curve showing the correspondence between the reflectance and the density.

FIG. 4 is a characteristic chart showing the correspondence between the reflectance and the density of a patch formed, wherein the longitudinal axis indicates the reflectance and the transversal axis indicates the density.

In FIG. 4, (1) to (3) on the transversal axis indicate the density level of the patch to be output by the CPU 101 in forming the image, while (1) to (3) on the longitudinal axis indicate the theoretical reflectance. Then, the voltage value of reflected light amount serves as data of predicated voltage value corresponding to the toner density level. On the contrary, (1)" to (3)" on the transversal axis indicate the actual density level of the toner image formed, and correspondingly A to C on the longitudinal axis indicate the sensor output which is obtained in practically measuring the density of the toner image, wherein the voltage value of the light source light amount is a detected voltage value.

Referring now to FIG. 4, the reference value setting for the operational amplifier 66 in accordance with the density detection voltage value level will be described below.

In FIG. 4, the target voltage value of reflected light amount is first set at Vref. Now, taking notice of a curve with Vref=1, the variation of sensor output can be widely secured to density variation around a density range of 1.5 to 1.8, but is smaller to density variation near a density range of 0 to 1.0.

Thus, by shifting Vref to 1 to 32 to increase the variation of sensor output near the density range of 0 to 1.0, the sensor output is controlled to be large for any of the density values. Vref=1 to 32 represent the ratio of reflected light amount, wherein the reflected light amount at Vref=32 is equal to 32 times the reflected light amount at Vref=1.

In the specific code setting, the CPU 101 sets code data of 6 bits to the D/A converter 75 as the reflected light amount voltage value Vref. Note that the code data is not limited to 6 bits.

With the above configuration, the CPU 101 has the predicated values of reflected light amount/direct light amount with respect to the density value as data, as shown in FIG. 4, wherein if a detection signal 74 is input into the CPU 101, the CPU 101 determines a voltage value Vref at which the variation of sensor output is large with respect to the variation of density level output in forming the density.

Figure 5:
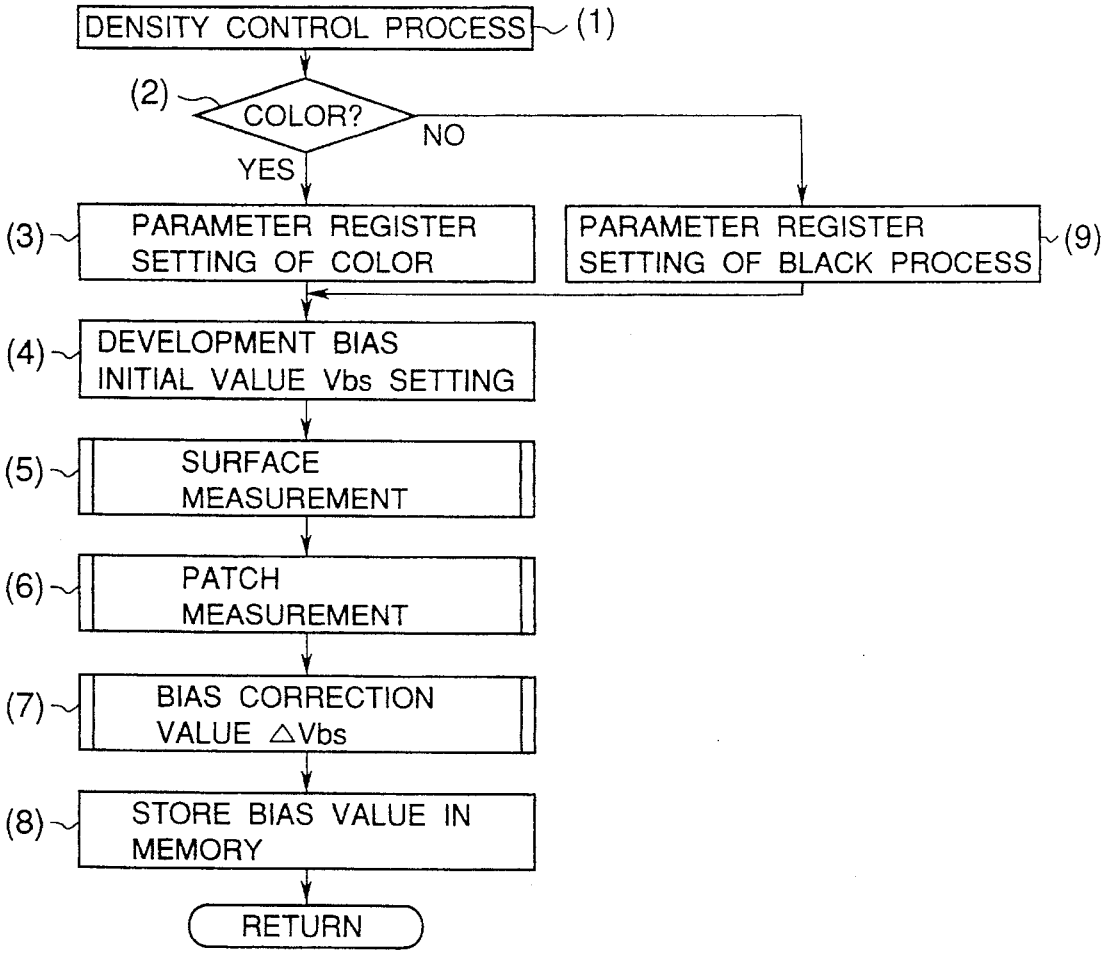
FIG. 5 is a flowchart exemplifying a first density processing procedure in the density control device according to the invention.
Figure 6:
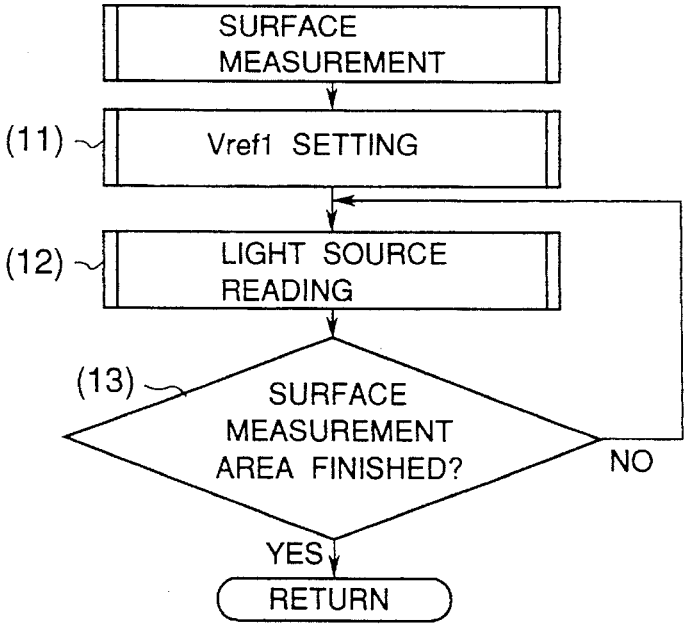
FIG. 6 is a flowchart exemplifying the first density processing procedure in the density control device according to the invention.
Figure 7:
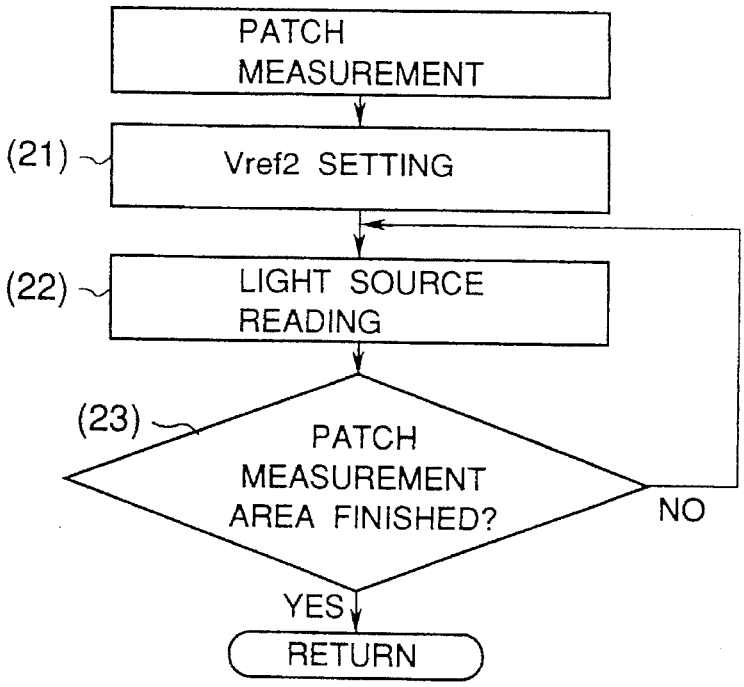
FIG. 7 is a flowchart exemplifying the first density processing procedure in the density control device according to the invention.
Figure 8:
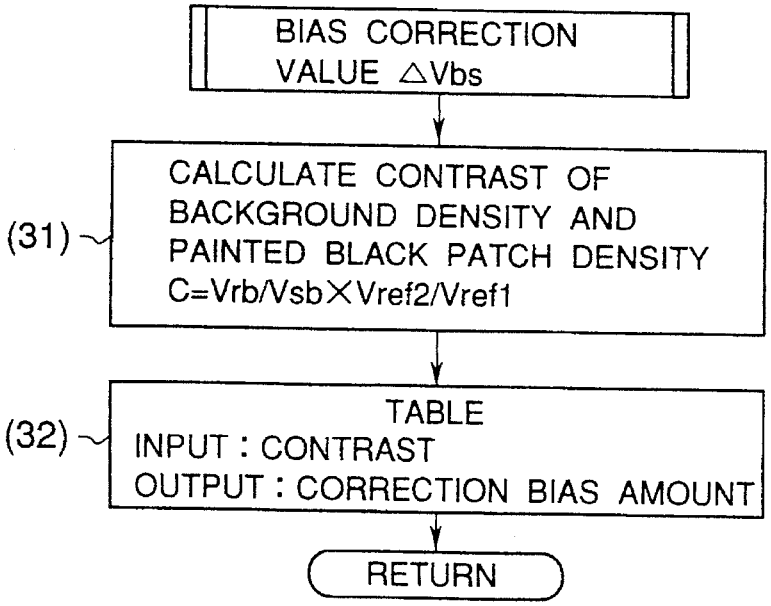
FIG. 8 is a flowchart exemplifying the first density processing procedure in the density control device according to the invention.

FIGS. 5 to 8 are flowcharts exemplifying a first density control process procedure of the density control device according to the invention, wherein FIG. 5 is a density control process, FIG. 6 is an underlying surface measuring process, FIG. 7 is a patch measuring process, and FIG. 8 is a bias correction value process. (1) to (8), (11) to (13), (21) to (23), (31) and (32) indicate each step.

Figure 9:
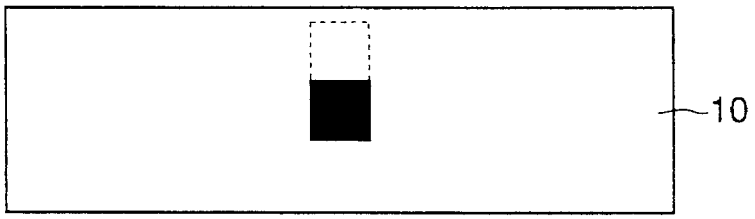
FIG. 9 is a view showing an example of a density patch in the density control device according to the invention.

In FIG. 5, upon entering the density control process, at step (1), if the recording of color image is determined, the color measurement parameters are set to respective registers (2), while if the recording of black-and-white image is determined, the black measurement parameters are set to respective registers (3). Then, the development bias is set at an initial value Vbs for the patch measurement (4), and the print sequence for forming the patch is started. First, the underlying surface measuring process as shown in FIG. 9 is started. When a patch of black toner is formed, the background or the region where no toner is attached is first reserved in a rotational direction, and then the painted black image is formed (see FIG. 9). And the background density measuring process is performed by means of a sensor.

Thus, the background reference voltage is first set at Vref1 (11). Because the light amount of the light source is increased, owing to a feedback function as above described, to the level multiplied by an inverse of the reflectance for the output, the light source light amount is measured to the end of the underlying surface region to be measured to obtain an average value thereof (12), (13).

Next, the patch measuring process as shown in FIG. 7 is started, whereupon the transfer drum is rotated, and the CPU 101 sets Vref2 as the reference voltage at a timing when the painted black patch arrives at the sensor position (21), whereby the light source light amount is similarly measured to the end of the patch region to be measured to obtain an average value thereof (22), (23).

In the above process, the relation of Vref1, Vrb, Vref2, Vsb, the density of underlying surface and the density of painted black patch is expressed as follows.

Supposing that the density of underlying surface is Du, and the density of painted black patch is Dt, the level Vrb of a detection signal for the density of underlying surface is expressed as:

$$Vrb=Vref1/10^{(Du)}$$

and the level Vsb of a detection signal for the density of painted black is expressed as:

$$Vsb=Vref2/10^{-(Dt+Du)}$$

When the signal having a value of the reference voltage multiplied by an inverse of the reflectance is output, the contrast value C of the density of painted black patch to the density of background is obtained from the expression (1) as below, based on Vrb, Vsb as above, as shown in FIG. 8 (31).

$$\begin{aligned} \text{Contrast value } C &= 10^{(Dt+Du)} - 10^{(Du)} \qquad (1) \\ &= (Vrb/Vref1)/(Vsb/Vref2) \\ &= Vrb/Vsb \times Vref2/Vref1 \end{aligned}$$

On the other hand, according to the density difference representation, the relation:

$$\Delta D=log(Vrb/Vsb)-log(Vref2/Vref1)$$

is given. Using the above expression, the contrast value C is obtained. And the bias correction value ΔVbs for the contrast value C obtained is determined by referring to a table where the relation of contrast value and bias correction value is memorized (32), and the obtained bias correction value is stored in a memory, whereby the process is ended.

Figure 10:
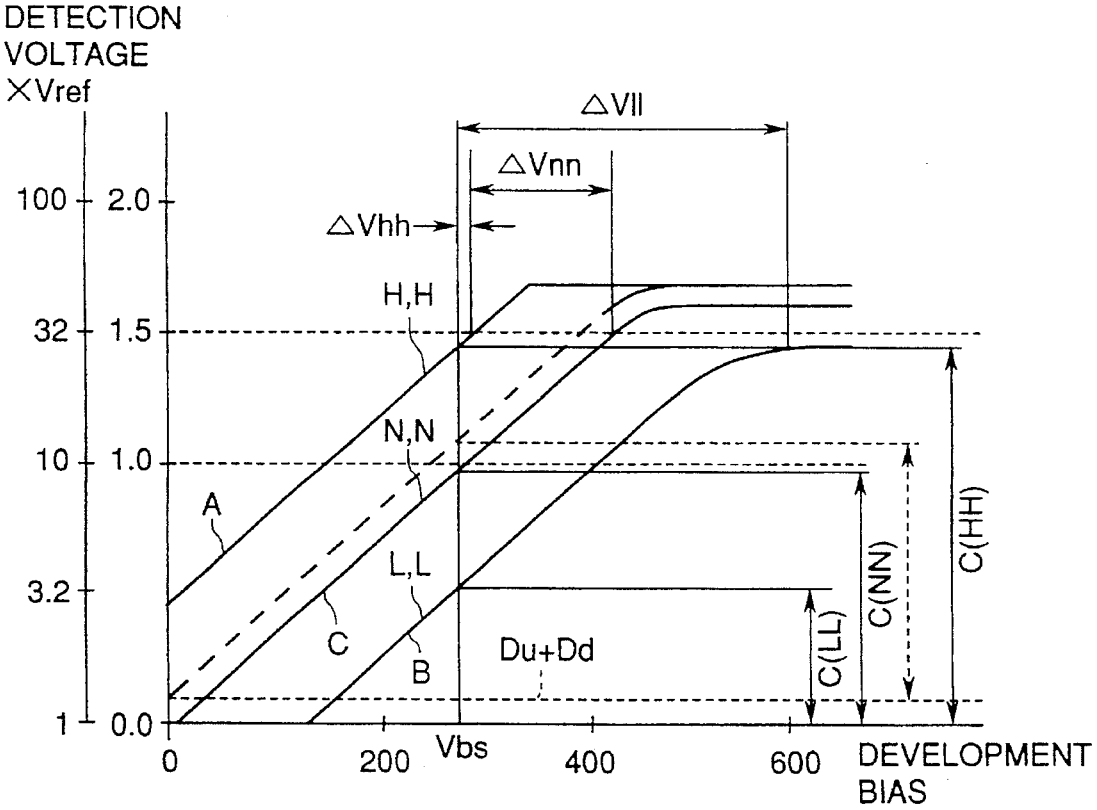
FIG. 10 is a chart showing the relation between the contrast value and the control parameter in the density control device according to the invention.

The relation between the contrast value and the development bias which is a control parameter is shown in FIG. 10.

FIG. 10 is a characteristic curve showing the relation between the contrast value and the control parameter in the density control device according to the invention, the transversal axis indicating the value of development bias and the longitudinal axis indicating the measurement density or the output (direct light amount) of the sensor, wherein the characteristic curve C represents a development characteristic at the ordinary temperature.

In the above description, the unclean sensor (case of diode 60, 61, 62) has not been referred to, and therefore the correction for the unclean sensor will be described below.

The unclean sensor may have the effect equivalent to that of decreased reflectance on the control system. That is, the amplifier 74 will output a higher result raised by a ratio corresponding to the light amount decreased due to the unclean sensor as the sensor output. Accordingly, representing the above expression with the sensor uncleanness as Dd, the signal Vrb detected in the underlying surface is:

$$Vrb=Vref1/10^{-(Du+Dd)}$$

and the signal Vsb detected in the painted black patch is:

$$Vsb=Vref2/10^{-(Di+Du+Dd)}$$

The contrast value C is calculated from Vrb and Vsb as above in the expression (2) as given below.

$$\begin{aligned} C &= 10^{(Di+Du+Dd)} - 10^{(Du+Dd)} \\ &= (Vrb/Vref1)/(Vsb/Vref2) \\ &= Vrb/Vsb \times Vref2/Vref1 \end{aligned} \quad (2)$$

On the other hand, according to the density difference representation, the relation:

$$\Delta D=log(Vrb/Vsb)-log(Vref2/Vref1)$$

is given.

In this way, as a result of calculation of the contrast value C, the sensor uncleanness Dd is offset. Accordingly, if Vref2/Vref1 is set as an appropriate value, it is possible to detect the output of the sensor light source without causing any overrange when inputting its output into the CPU, and without decreasing the s/n ratio, while suppressing the influence of dark current of the light receiving element to the minimum.

[Second Example]

Figure 11:
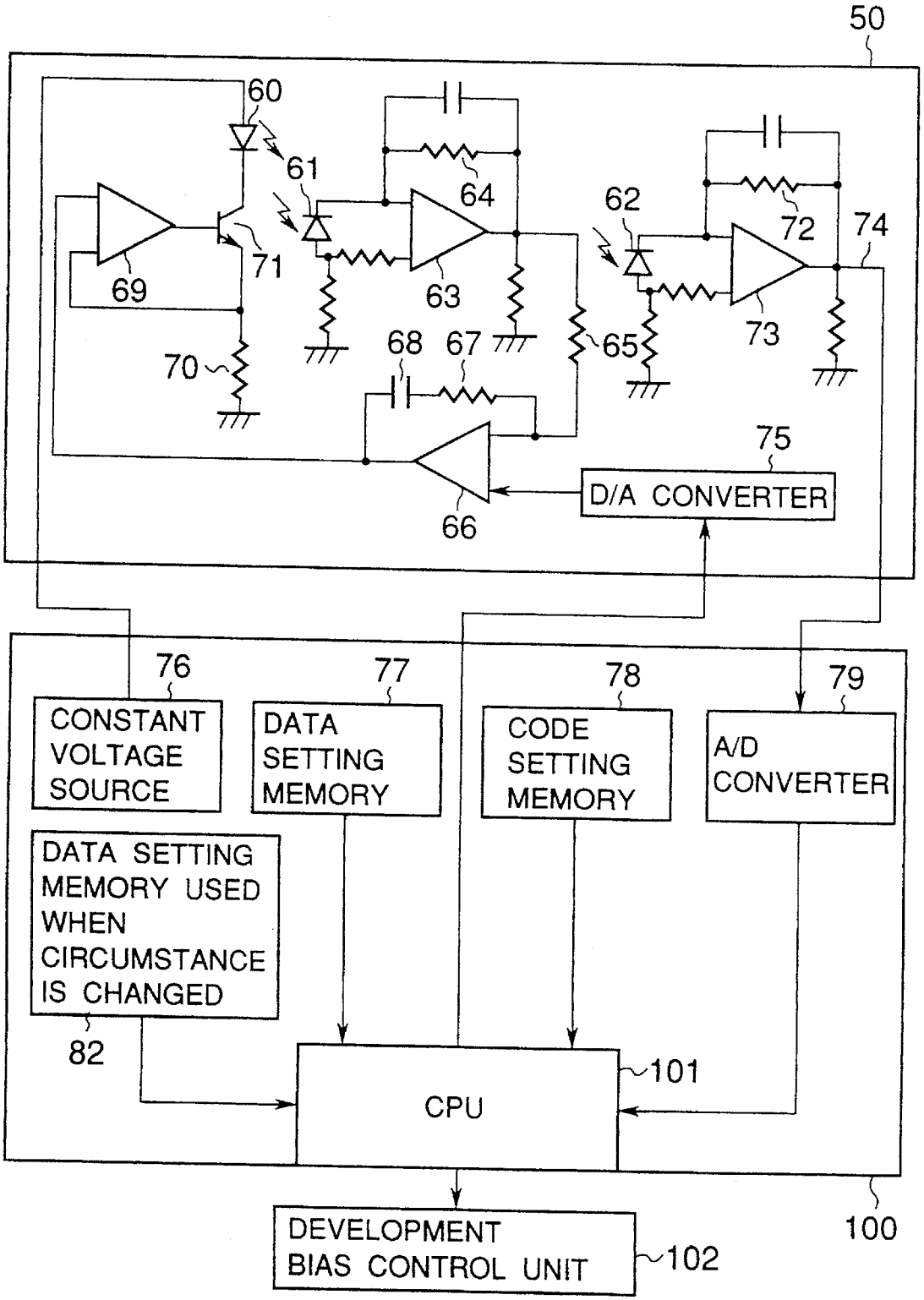
FIG. 11 is a block diagram for explaining the configuration of a density control device in a second example of the invention.

FIG. 11 is a block diagram for explaining the configuration of a density control device in a second example of the present invention.

In the figure, 82 is a data setting memory for use when there are environmental variations (high temperature and high humidity, low temperature and low humidity). Other configuration fundamentally involves the identical functions of the device as described in the first example, and will not be described.

In FIG. 10, a curve A on the upper side (high density side) represents the characteristic under the conditions of high temperature and high humidity (HH), and a curve B on the lower side (low density side) represents the characteristic under the conditions of low temperature and low humidity (LL), each being shown as the abstract model. A curve C represents the characteristic under the conditions of ordinary temperature and ordinary humidity (NN). Herein, the characteristic curve between development bias and image density and the variation of the characteristic curve with the circumstance are shown in FIG. 12, each as the abstract model.

Figure 12:
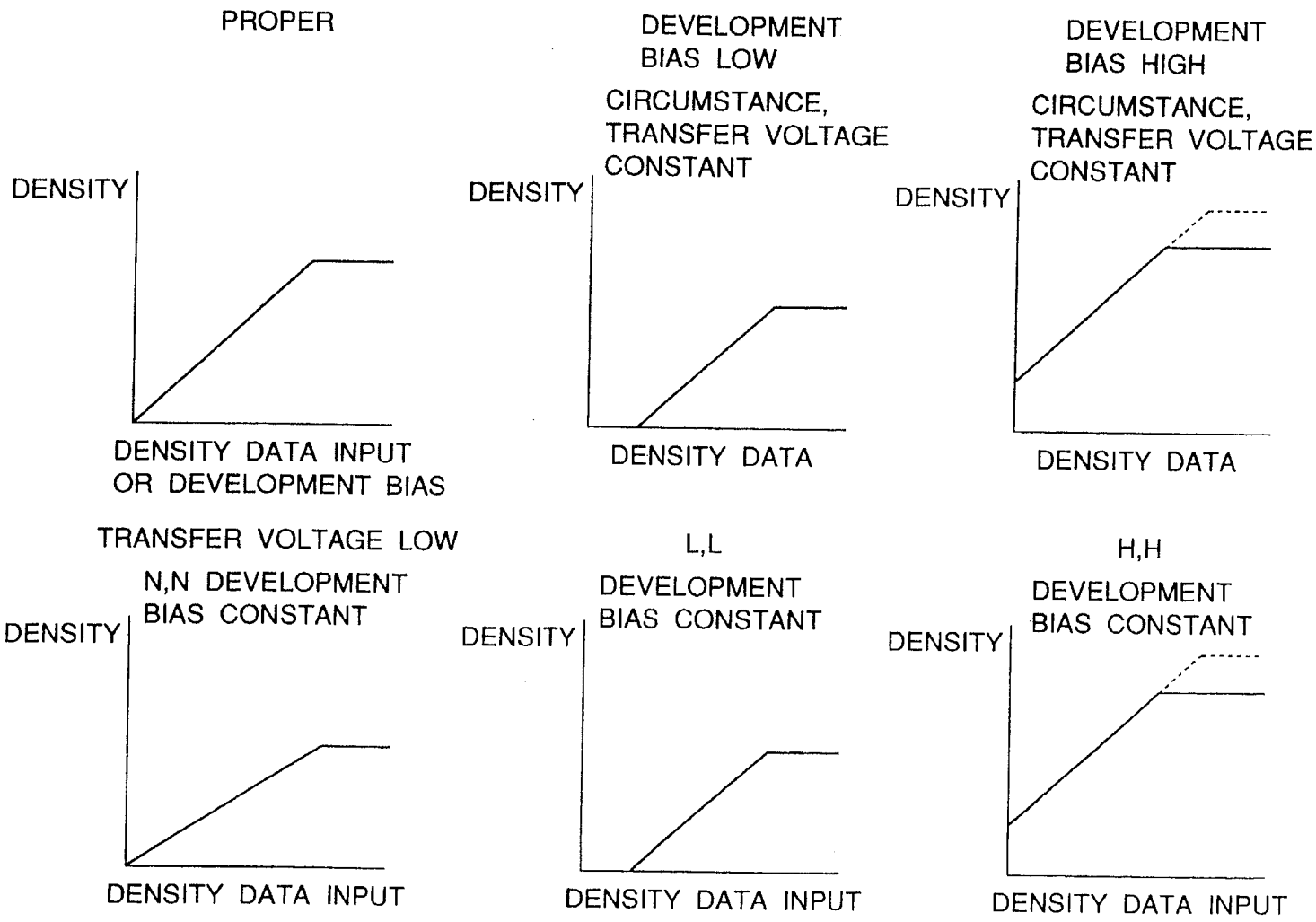
FIG. 12 is a chart showing the relation between the development bias and the density in the density control device of this type, when subjected to environmental variations.

FIG. 12 is curves representing the relation between the development bias and the density in the density control device when the circumstance is changed.

As shown in FIG. 12, the environmental variation (HH, LL, NN) has the equivalent effect to that when the development bias is changed.

Accordingly, the correction for the density can be made by the development bias.

In FIG. 10, the density level detected by the development bias initial value Vbs preset is represented as C (LL) in the low temperature and low humidity, C (NN) in the ordinary temperature and ordinary humidity, and C (HH) in the high temperature and high humidity.

ΔV(LL) in the low temperature and low humidity, ΔV(NN) in the ordinary temperature and ordinary humidity, and ΔV(HH) in the high temperature and high humidity, as the incremental amount of a development bias initial value Vbs corresponding to an ideal development bias value (e.g., a development bias to obtain a density of 1.6) for the contrast value of the painted black density to the background density as calculated in the above expression (1), are prestored as the table or the calculation expression in a ROM. And by inputting the contrast value calculated by the development bias initial value Vbs, the bias value (or correction incremental amount ΔVbs) is obtained and stored in a memory.

In the normal printing sequence, the development bias is corrected incrementally, using a correction incremental amount ΔVbs obtained as above, whereby the stable density control can be always made in spite of the environmental variations which may possibly happen.

While the above description is concerned with the black image process, it will be understood that in the case of the color image, it involves the characteristic of reflecting the light in a light source wavelength region ranging from about 800 to 1000 nm. The detection signal in the underlying surface is:

$$Vrb=Vref1/(1-10^{-(Du)})$$

and that in the painted image patch is:

$$Vsb=Vref2/(1-10^{-(Di+Du)})$$

In this way, if the signal having a value of the reference voltage multiplied by an inverse of the reflectance is output, the contrast of the patch processed portion to the background is calculated from Vrb, Vsb as above, to have the contrast value C in accordance with the following expression (3):

$$C=(Vrb/Vsb)\times(Vsb-Vref2)/(Vrb-Vref1) \quad (3)$$

Figure 13:
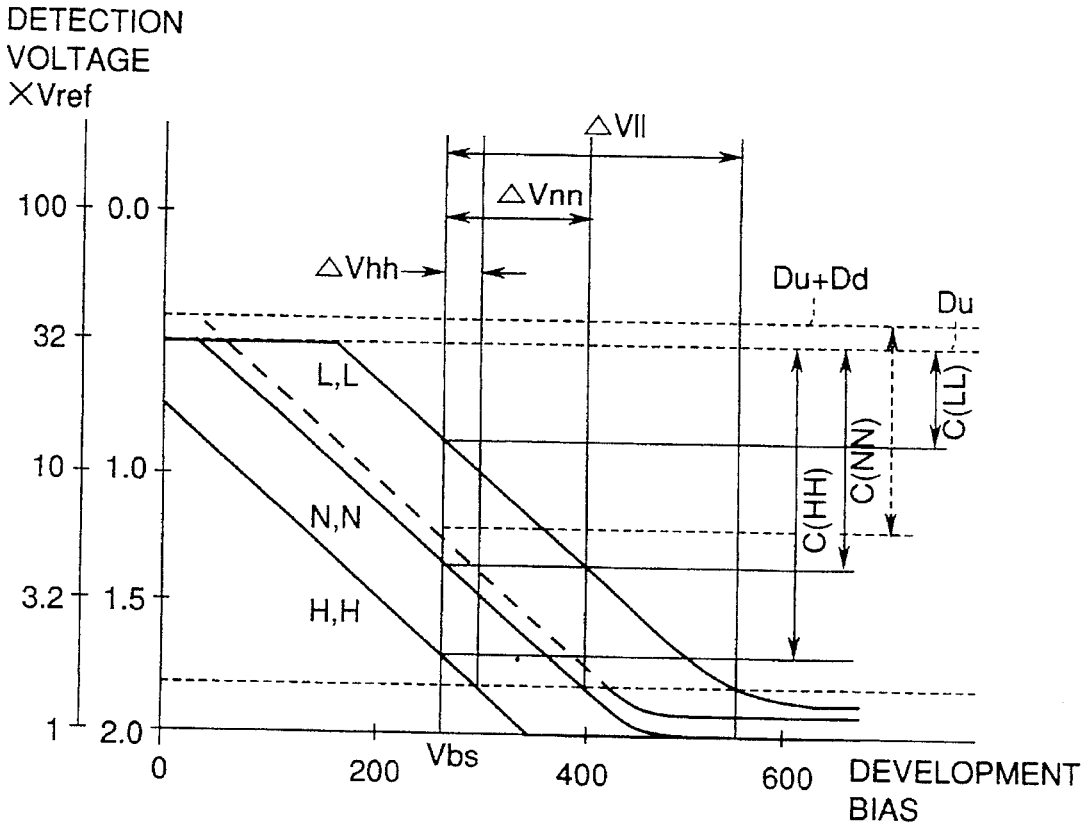
FIG. 13 is a characteristic chart showing the relation between the contrast value and the control parameter in the density control device according to the invention.

Accordingly, the relation between the development bias and the image density results in the characteristic as shown in FIG. 13, which is sloped reversely to the characteristic of FIG. 10.

In FIG. 13, the operation principle is the same as the black process, but the background density is at a higher level as the detection voltage.

Accordingly, the contrast value C under the environmental conditions can be represented by the relative value to the background density Du. Other processing is the same as the black image process, and will not be described.

Such a phenomenon has been observed that under the circumstance of high temperature and high humidity, the transfer efficiency is enhanced due to variations in the high voltage and the friction electrification voltage at the development, and other various factors, which may be caused by varying high temperature and high humidity, while under the circumstance of low temperature and low humidity, the transfer efficiency is decreased.

It is reasonable to increase the transfer high voltage continuously from the normal use, but such a phenomenon has been observed that if a higher voltage than necessary is applied to the circumstance where the device is placed, the transfer efficiency is remarkably decreased due to the punch-through of toner charge.

Thus, one compensation method for decreased transfer efficiency involves, in the second example, increasing the transfer high voltage simultaneously with the development bias, when the contrast value exceeds a predetermined value, as described in the first example, to transfer the toner of the photosensitive drum onto the transfer body at higher efficiency.

Figure 14:
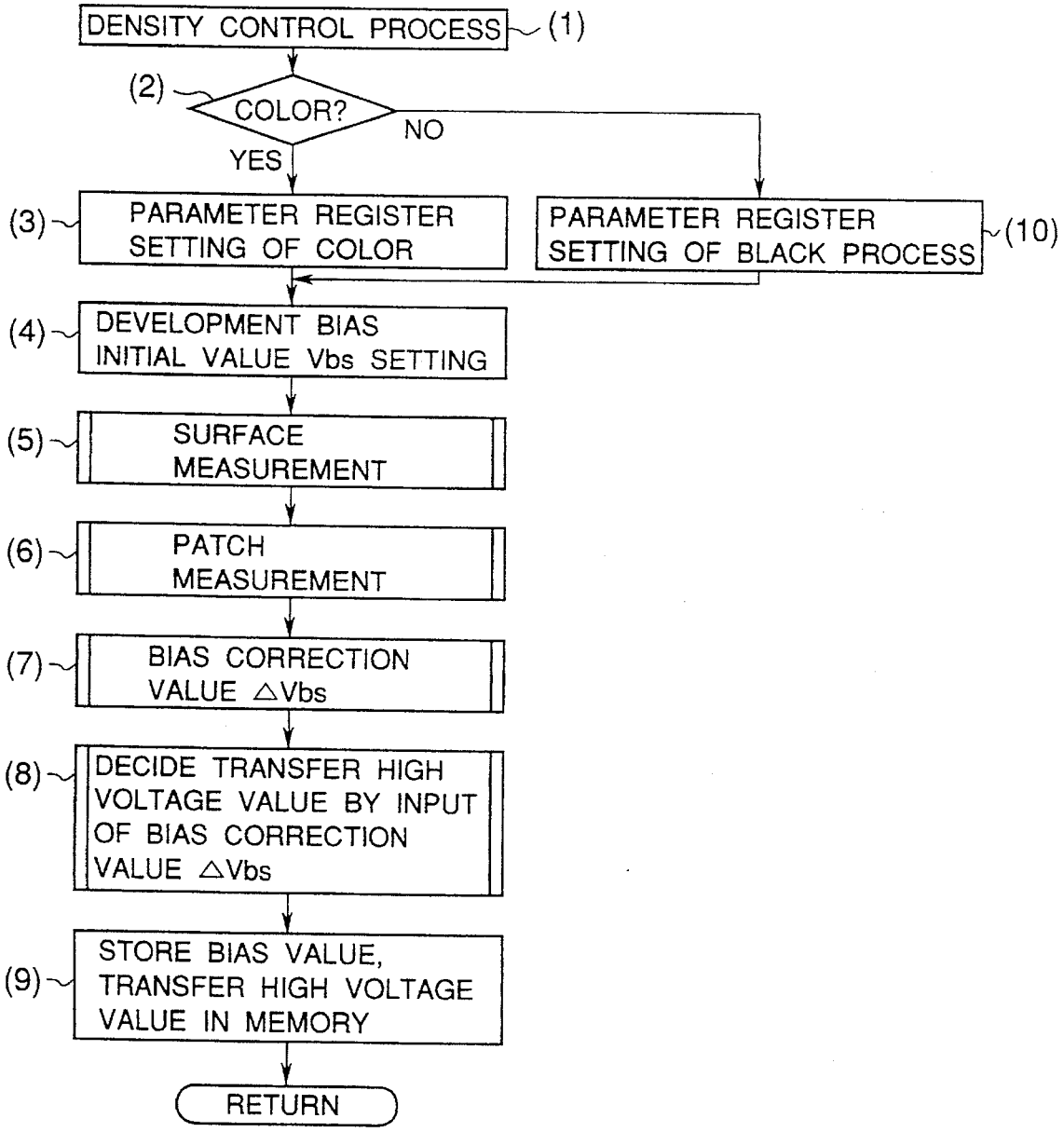
FIG. 14 is a flowchart exemplifying a second density processing procedure in the density control device according to the invention.

FIG. 14 is a flowchart exemplifying a second density process procedure of the density control device according to the present invention, wherein (1) to (9) indicate each step. The steps (1) to (7) are fundamentally equivalent to those of the process of FIG. 5. At step (8), the transfer high voltage is determined, based on the bias correction value determined, and at step (9), the bias value and the transfer high voltage value are stored in the memory.

Figure 15:
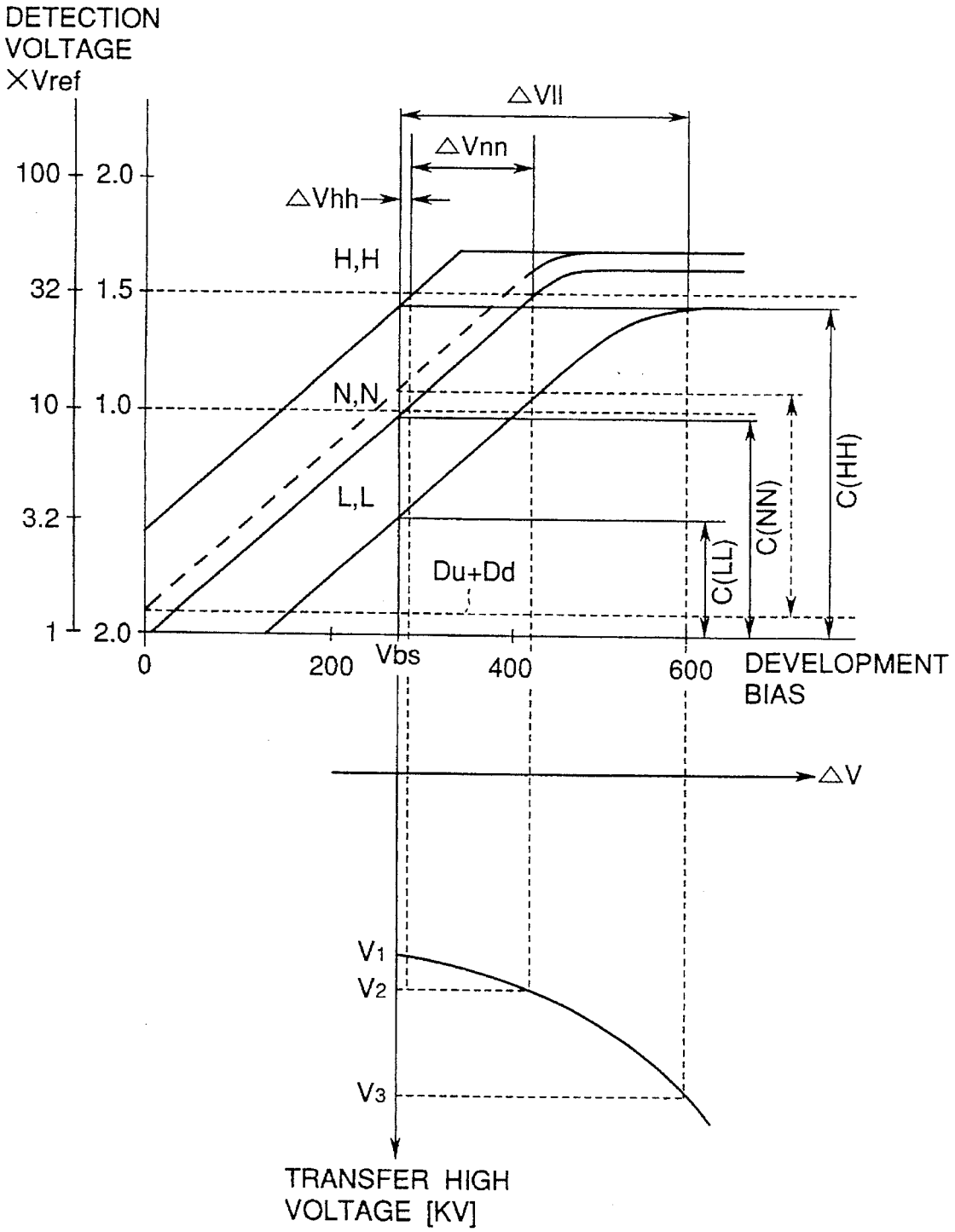
FIG. 15 is a characteristic chart for explaining the relation between the bias value and the transfer high voltage value in the density control device according to the invention.
Figure 16:
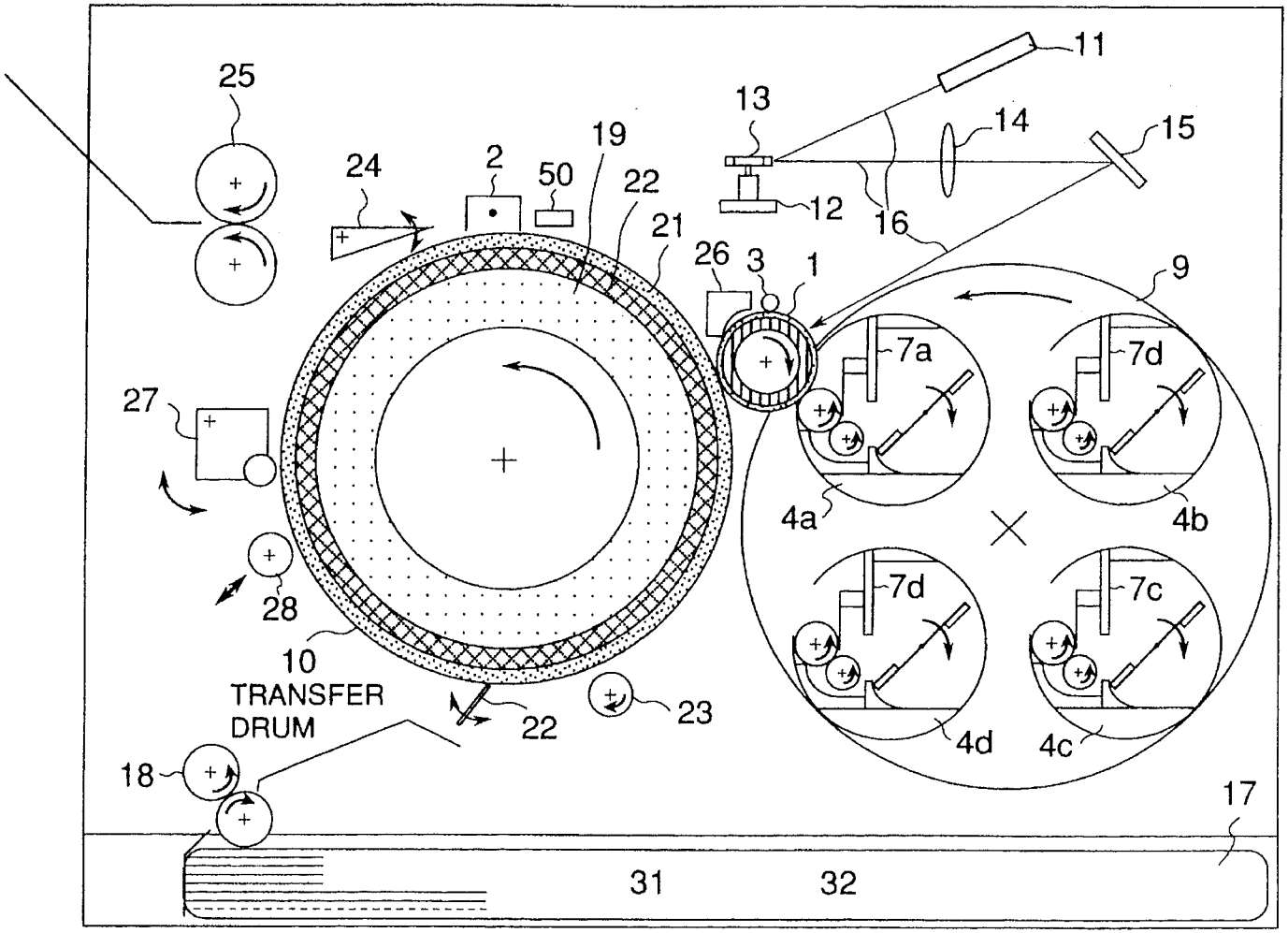
FIG. 16 is a cross-sectional view showing an example of a color image forming apparatus of this type.
Figure 17:
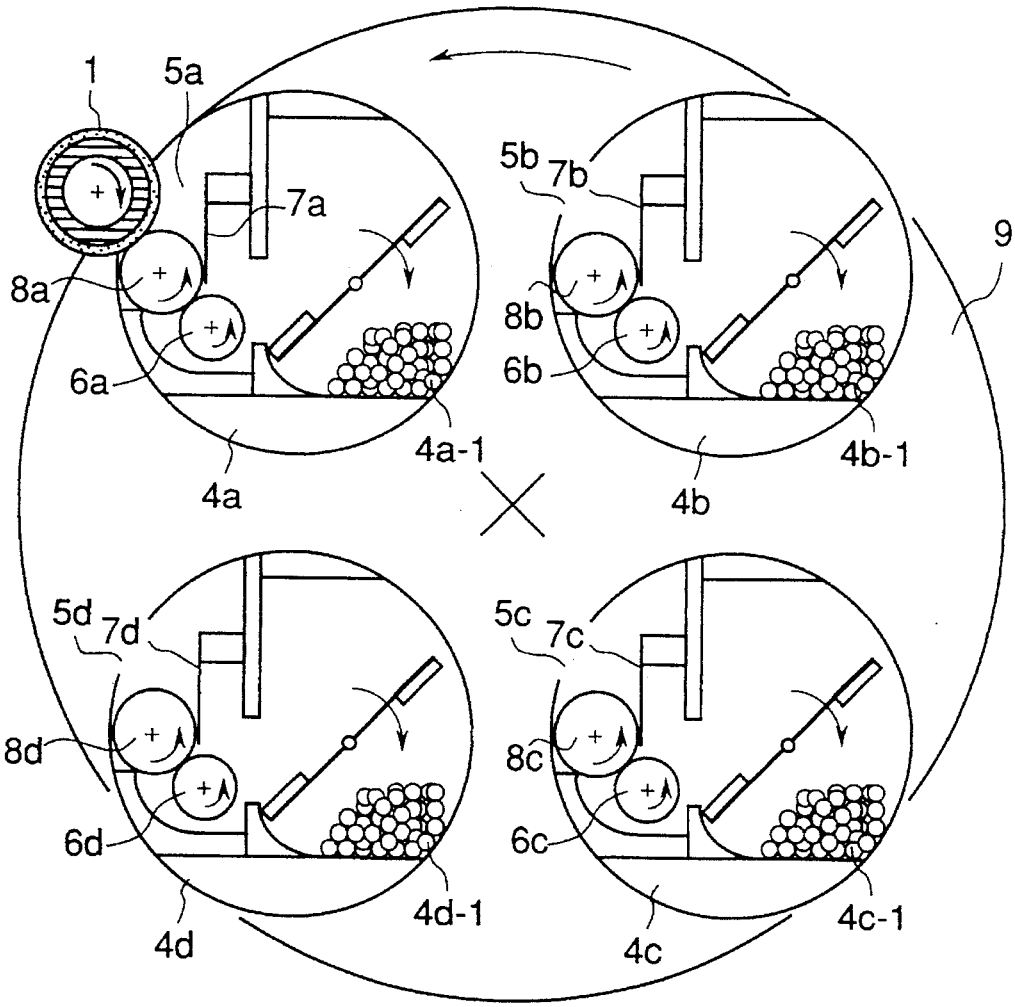
FIG. 17 is a cross-sectional view for explaining the detailed construction of a developing cartridge as shown in FIG. 16.
Figure 18:
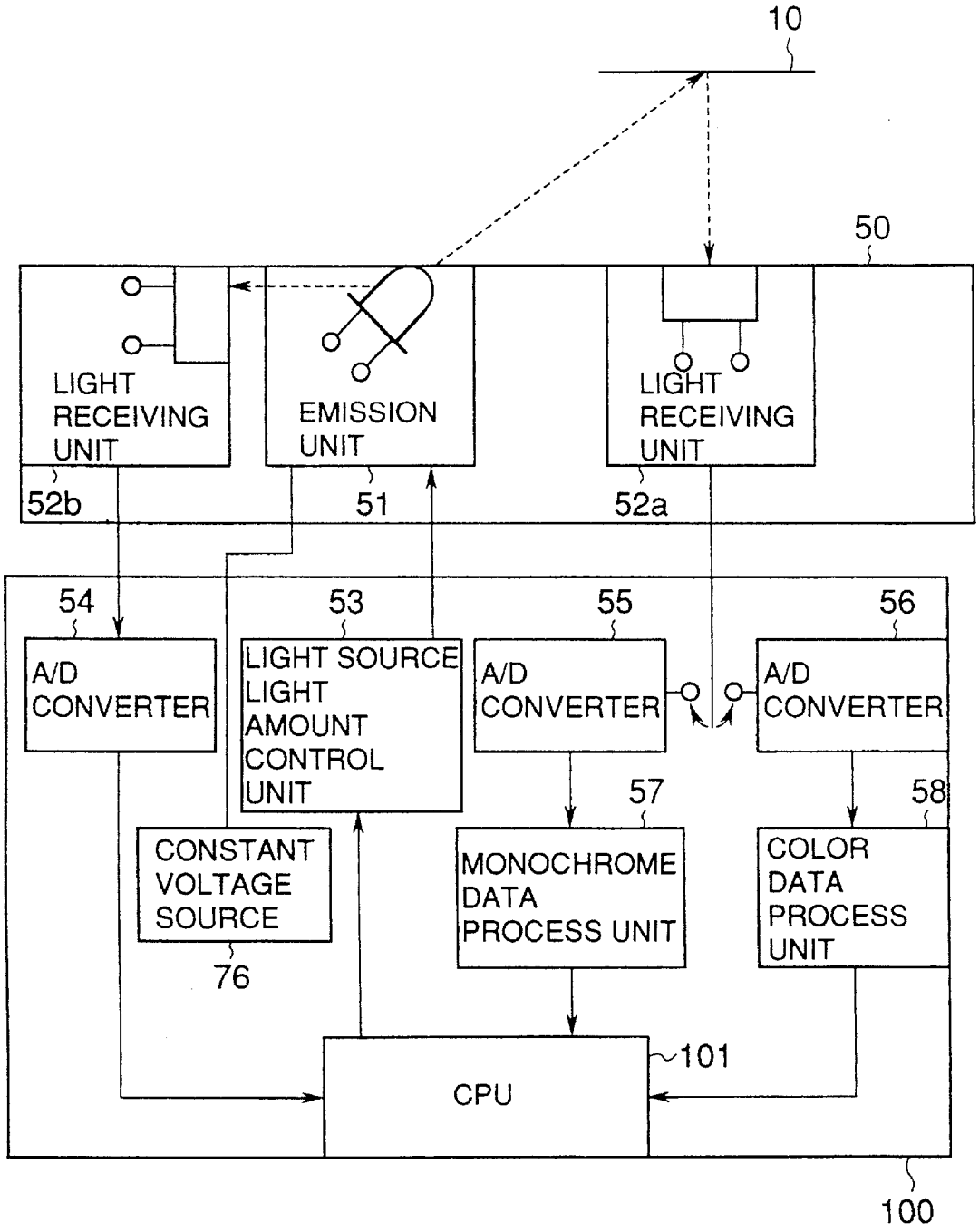
FIG. 18 is a block diagram for explaining the configuration of a density control circuit using a density sensor as shown in FIG. 16.

FIG. 15 is the characteristic curve for explaining the relation between the bias value and the transfer high voltage value in the density control device according to the present invention, the transverse axis indicating the development bias and the longitudinal axis indicating the density or sensor output.

In FIG. 15, when the contrast value obtained at ordinary temperature is equal to or less than C (NN), the image compensation can be made by changing the parameter for only the development bias value, while when it is equal to or greater than C (NN), the density control at high precision is enabled by changing the parameter in connection with the development bias value or the contrast value.

With the above example, as a result of dividing the detection signal obtained by measuring the density of toner patch by the detection voltage obtained by measuring the density of background, that is, by controlling the image forming conditions of the printer, using the contrast value, and adopting a way of detecting the light source light amount so that the reflected light detection amount may be equal to a set value, the optimal preparation of the toner density can effected despite the environmental variations, whereby the stable color image can be output.

Since the detection of patch density is processed by the contrast value relative to the background density, the effects such as unclean sensor and unclean light source can be reduced to the minimum.

Further, the sensor is provided with a feedback processing circuit to detect the light source light amount so that the strength of reflected light amount equals the value indicated from a sequence controller at any time, whereby the sensor signal with good S/N ratio can be obtained at high density. Since the control system comprised of a light receiving sensor is made a closed loop with a gain 1, the detection precision may not be affected even if the efficiency of the luminescent light source decreases with the secular change.

Further, the sensor system which is constituted by a closed loop, that is, with a gain of "1", can eliminate any standby lighting, and can be only lighted at necessary timings, that is, the life of the light source can be lengthened.

In this way, with the above example, the full-color printer is constituted to be able to vary the development bias and (or) the transfer voltage in accordance with the signal level obtained from a reflected light amount measuring system and a direct light amount measuring system comprised of a luminescent light source and the light receiving sensors for the image forming processes (photosensitive drum electrification, exposure, development, transfer) for each color of the full-color printer, whereby the proper synthesis of primary color toners can be effected, despite environmental variations, by measuring the value of the reference density member preattached to the transfer drum and the density formed by the toner, calculating the contrast value, and determining the development bias in accordance with the contrast value.

The present invention is not limited to the above-described examples, and various variations can be made within the scope as defined in the claims.

What is claimed is:

1. An image forming apparatus comprising:

image forming means for forming an arbitrary image which includes a sample image having a predetermined density onto a recording medium;

illuminating means for illuminating said sample image formed on said recording medium;

first light receiving means for receiving reflected light from said sample image;

second light receiving means for receiving light directly from said illuminating means;

light amount control means for controlling said illuminating means so that an output from said first light receiving means is at a predetermined value; and control means for determining operation conditions of said image forming means which relate to a density of an image to be formed by said image forming means, based on an output of said second light receiving means when the output of said first light receiving means is equal to said predetermined value.

2. An image forming apparatus according to claim 1, wherein said image forming means forms a multi-color image.

3. An image forming apparatus according to claim 1, wherein said light amount control means has setting means for setting said predetermined value variably.

4. A density control method for an image forming apparatus, comprising steps of:

a) forming a sample image having a predetermined density onto a recording medium;

b) illuminating the sample image formed on the recording medium using a luminescent element;

c) a first receiving step for receiving light reflected from the sample image;

d) a second receiving step for receiving light directly from the luminescent element;

e) controlling the luminescent element so that an amount of light received in said first receiving step is at a predetermined value; and f) determining operation conditions which relate to a density of an image to be formed by the image forming apparatus, based on an amount of light received in said second receiving step when the amount of light received in said first receiving step is equal to the predetermined value.

5. A method according to claim 4, wherein said image forming apparatus forms an image using an electrophotographic system, and wherein said determining step determines a development bias of said image forming apparatus.

6. A method according to claim 4, wherein said controlling step changes the predetermined value according to a density of the sample image formed in said forming step.

7. An image forming apparatus comprising:

image forming means for forming an arbitrary image which includes a sample image having a predetermined density onto a recording medium;

illuminating means for illuminating the recording medium on which the sample image is formed;

detecting means for detecting an amount of light reflected from the recording medium; and control means for determining operation conditions for said image forming means which relate to a density of an image to be formed by said image forming means, based on (i) an amount of light obtained from said illuminating means when the amount of light detected by said detecting means from a part of the recording medium on which the sample image is not formed is equal to a first predetermined value, and (ii) an amount of light obtained from said illuminating means when the amount of light detected by said illuminating means from a part of the recording medium on which the sample image is formed is equal to a second predetermined value.

8. An apparatus according to claim 7, wherein said control means determines the operation conditions based on a difference between the amount of light from said illuminating means when the amount of light detected by said detecting means is equal to the first predetermined value and the amount of light from said illuminating means when the amount of light detected by said detecting means is equal to the second predetermined value.

9. An apparatus according to claim 7, wherein said image forming means includes developing means for developing a latent image formed on the recording medium and wherein said control means determines a development bias of said developing means.

10. An apparatus according to claim 7, wherein said control means further determines the operation conditions according to a circumstance condition.

11. A density control method for an image forming apparatus, comprising steps of:

a) forming a sample image having a predetermined density onto a recording medium;

b) a first illuminating step for illuminating a part of the recording medium on which the sample image is not formed;

c) a first obtaining step for obtaining an amount of illuminating light when an amount of light reflected from the recording medium illuminated in said first illuminating step is equal to a first predetermined value;

d) a second illuminating step for illuminating a part of the recording medium on which the sample image is formed;

e) a second obtaining step for obtaining an amount of illuminating light when the amount of light reflected from the sample image illuminated in said second illuminating step is equal to a second predetermined value; and f) determining operation conditions which relate to a density of an image to be formed by the image forming apparatus, based on the amount of light obtained in said first obtaining step and the amount of light obtained in said second obtaining step.

12. A method according to claim 11, wherein said determining step determines the operation conditions based on a difference between the amount of light obtained in said first obtaining step and the amount of light obtained in said second obtaining step.

13. A method according to claim 11, wherein said image forming apparatus forms an image using an electrophotographic system, and wherein said determining step determines a development bias for the image forming apparatus.

14. A method according to claim 11, wherein said determining step further determines the operation conditions according to a circumstance condition.

* * * * *

UNITED STATES PATENT AND TRADEMARK OFFICE

CERTIFICATE OF CORRECTION

PATENT NO. : 5,568,234

DATED : October 22, 1996

INVENTOR(S) : Hiroshi Shiba

It is certified that error appears in the above-indentified patent and that said Letters Patent is hereby corrected as shown below:

Column 8,

Line 22, "$10^{(Du)}$" should read --$10^{-(Du)}$--.

Signed and Sealed this

Fourth Day of March, 1997

Bruce Lehman

*Attest:*

BRUCE LEHMAN

*Attesting Officer*

*Commissioner of Patents and Trademarks*